United States Patent [19]

Knabel et al.

[11] 4,405,151

[45] Sep. 20, 1983

[54] LOCKING DEVICE FOR AN ELECTRONIC SAFETY SKI BINDING

[75] Inventors: Walter Knabel, Farchant; Gerd Klubitschko, Oberau; Lorenz Stempfhuber, Garmisch-Partenkirchen, all of Fed. Rep. of Germany; Nicholas F. D'Antonio, Liverpool, N.Y.

[73] Assignee: Marker Patentverwertungsgesellschaft mbH, Baar, Switzerland

[21] Appl. No.: 243,920

[22] PCT Filed: Jul. 16, 1980

[86] PCT No.: PCT/EP80/00058

§ 371 Date: Mar. 2, 1981

§ 102(e) Date: Mar. 2, 1981

[87] PCT Pub. No.: WO81/00216

PCT Pub. Date: Feb. 5, 1981

[30] Foreign Application Priority Data

Jul. 16, 1979 [DE] Fed. Rep. of Germany ..... 2928681

[51] Int. Cl.[3] ..... A63C 9/08

[52] U.S. Cl. ..... 280/612

[58] Field of Search ..... 280/611, 612, 616, 630, 280/631; 292/201, 98, 124, 197, 224, 150; 70/280, 275, 276

[56] References Cited

U.S. PATENT DOCUMENTS

| | | | |
|---|---|---|---|
| 3,794,339 | 2/1974 | Smolka | 280/612 |
| 3,907,316 | 9/1975 | Marker | 280/612 |

FOREIGN PATENT DOCUMENTS

| | | |
|---|---|---|
| 1070345 | 1/1980 | Canada . |
| 319110 | 12/1974 | Switzerland . |
| 324903 | 9/1975 | Switzerland . |

*Primary Examiner*—Joseph F. Peters, Jr.
*Assistant Examiner*—Kenneth R. Rice
*Attorney, Agent, or Firm*—Squire, Sanders & Dempsey

[57] ABSTRACT

A locking device for an electronic safety ski binding comprises two interengaged locking members of which the locked member is connected to a sole retainer and is movable between its releasing and its retaining position in which it is held by the locking other member which is movable by an electromagnet. To provide a shock-proof lock for an electronic safety ski binding with a reliably operative electromagnet, a rotary magnet is provided to move the locking member.

6 Claims, 1 Drawing Figure

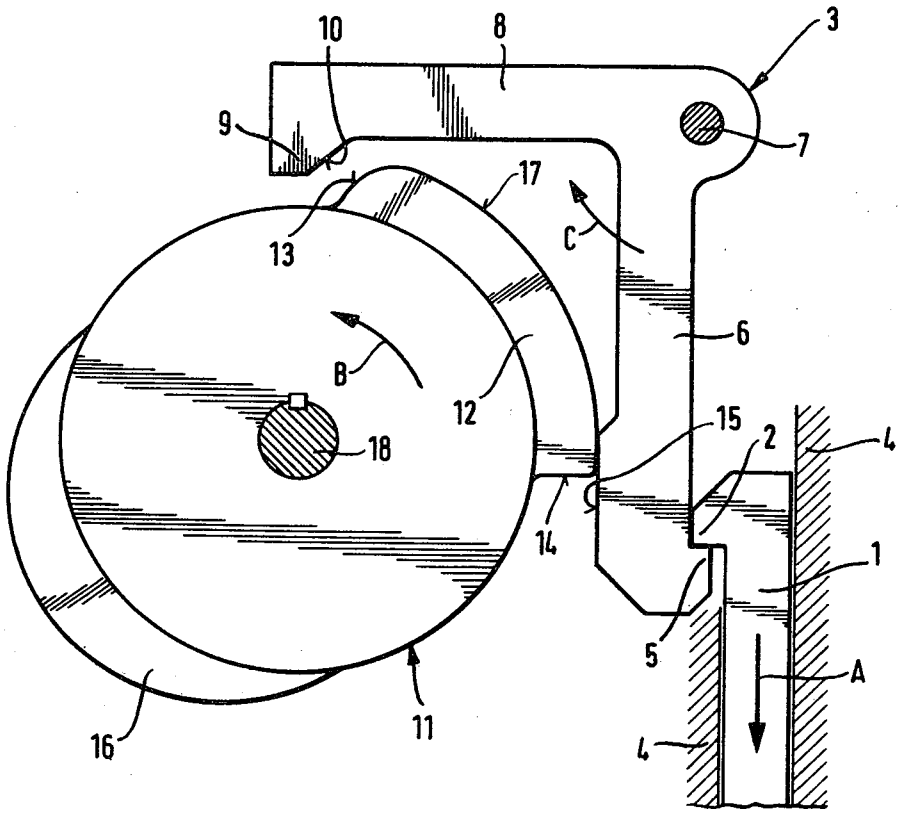
3
7
8
10
9
17
C
6
15
2
1
4
A
4
5
14
12
13
B
18
11
16

LOCKING DEVICE FOR AN ELECTRONIC SAFETY SKI BINDING

The invention relates to a locking device for an electronic safety ski binding comprising two interengaged members of which the locked member is connected to a sole retainer and is movable between its releasing and its retaining position in which it is held by the locking other member which is movable by an electromagnet.

Electronic safety ski bindings known for example from DE-OS No. 22 44 949 and 25 19 544 consist of force receivers which emit electric signals and detect forces and/or torques acting on the leg of a skier, and an electronic circuit which, on occurrence of dangerous forces or torques, actuates the releasing device by means of a releasing signal. The mechanical releasing device comprises a lock which is released by the force of an electromagnet operated by the releasing signal. Rod or U-shaped electromagnets are employed of which the force exerted on the movable armature primarily depends, inter alia, on the length of the air gap and which are unable to prevent release of the lock through vibrations or other external influences.

It is therefore the problem of the present invention to provide a shockproof lock for an electronic safety ski binding that is provided with a reliably operative electromagnet.

According to the invention, this problem is solved in that a rotary magnet is provided to move the locking member.

In a constructional embodiment of the invention, the locking member comprises a pivotably mounted two-armed lever of which the first arm is provided with a hook-shaped projection holding the locked member in the retaining position and the second arm is engaged by a cam which is secured to the shaft of the rotary magnet and which, on actuation, brings the hook-shaped projection out of engagement with the locked member. Desirably, the arms of the two-armed lever are at an angle to each other, the second arm comprising a projection disposed in the pivotal path of the cam moved by the rotary magnet. The cam disposed at the periphery of a plate and the projection may be provided with substantially complementary oblique faces and/or curved ramps.

Unintentional release of the locking device as a result of shocks is reliably avoided in that, adjoining the oblique face or curved ramp, the cam has an end face which is concentric with the plate and, in the locked position, abuts a projection which is disposed on the side of the first arm opposite to the hook-shaped projection and runs off same when the rotary magnet has turned the plate so far that the cam is just leaving the projection of the second arm. According to this inventive development, the locked member is reliably held in its locked position in that the cam holds the first arm in its position at which it is locked to the locked member and releases same only when, for the purpose of pivoting the two-armed lever, it runs onto the projection provided on its second arm.

Desirably, a counterweight is disposed on the side of the plate opposite to the cam for compensating the weight and flywheel effect thereof.

One example of the invention will now be described in more detail with reference to the drawing in which the single FIGURE is a diagrammatic front elevation of the locking device.

The slide 1 forms a locked member which is connected in a manner not illustrated to the sole retainer of an electronic safety ski binding and in its illustrated retaining position, is latched to the locked member consisting of a two-armed lever 3. For instance, FIG. 6 of DE-OS No. 25 19 544 illustrates a ski binding having a handle similar to the slide 1 that has a right-hand end forming a latching element similar to latching lug 2 of the slide 1. Movement of the handle controls movement of a heel plate stud that locks a ski boot securely to a ski.

The slide 1 is subjected in the direction of the arrow A to the force of a spring (not shown) and held for longitudinal displacement in a longitudinally extending guide of the housing 4. At its outer free end, the slide 1 comprises a latching lug 2 behind which there is engaged in the illustrated retaining position the latching lug 5 of the first arm 6 of the two-armed lever 3. In the illustrated locked position, the slide 1 and the first arm 6 are substantially parallel.

The two-armed lever 3 is pivotably mounted in the housing about the stud 7 which is fixed with respect to the housing. The second arm 8 of the two-armed lever 3 is at right-angles to the first arm 6. At its free outer end, the second arm 8 has a projection 9 which is provided with an oblique ramp 10.

A cam plate 11 disposed in the plane of the two-armed lever 3 is fixed onto the shaft 18 of the rotary magnet that extends parallel to the stud 7. A cam 12 placed on the arcuate portion of the cam plate 11 extends over approximately one quarter of the circumference of the arcuate portion of the cam plate 11. The front end of the cam 12 as viewed in its direction of rotation B comprises a curved ramp which, by rotation of the cam plate 11, runs onto the oblique ramp 10 of the projection 9. Adjoining the curved ramp 13, the cam 12 has an outer end face which is curved concentrically to the shaft of the rotary magnet. At its rear end, the cam comprises a step 14 by which it falls substantially at right-angles onto the edge of the substantially circular portion of the cam plate 11.

At its free side opposite the lug 5, the first arm 6 of the two-armed lever 3 comprises a projection 15 which, in the illustrated locked position, is supported on the arcuate peripheral surface of the cam 12.

The lock between the first arm 6 and the slide 1 is released in that the rotary magnet turns the cam plate in the direction of the arrow B until the curved ramp of the cam 12 abuts the inclined face of the projection 9 and, on further rotation, pivots the two-armed lever 3 in the direction of the arrow C. Shortly before the ramp 13 abuts the ramp 10, the step 14 of the cam 12 is turned beyond the rear edge of the projection 15 so that the first arm 6 thereby becomes unblocked and the lugs 2, 5 are disengaged by the two-armed lever 3 being pivoted.

To compensate the weight of the cam 12, the counterweight 16 is secured to the opposite side of the cam plate 11.

Springs (not shown) may be provided to return the two-armed lever 3 and the rotary magnet after release of the lock.

We claim:

1. A locking device for an electronic safety ski binding, said locking device comprising:

a locked member connected to a sole retainer and movable between a releasing position and a retaining position;

a locking member for holding the locked member in its retaining position and including a pivotably mounted two-armed lever having a first arm provided with a hook-shaped projection for holding the locked member in the retaining position and a second arm; and an electromagnet for moving the locking member, said electromagnet including a rotatable magnet having a rotatable shaft, and a cam secured to the shaft for engaging the first arm of the locking member to hold the first arm in a position for retaining the locked member in the retaining position, and means to move the second arm to move the hook-shaped projection to release the locked member from the retaining position upon actuation of the electromagnet.

2. A locking device according to claim 1 wherein the arms of the two-armed lever are at an angle to each other and said means to move the second arm comprise a projection on the second arm disposed in the path of movement of the cam, the cam engaging the projection to move the two-armed lever upon actuation of the electromagnet.

3. A locking device according to claim 2, wherein the electromagnet further comprises a plate secured to the shaft, the cam being disposed at the periphery of the plate, the cam and the projection on the second arm having substantially complementary oblique faces and/or curved ramps.

4. A locking device according to claim 3, wherein the cam has a curved end face having an axis of rotation coincident with the axis of rotation of the shaft and the first arm having a projection opposite to the hook-shaped projection, the end face engaging the projection on the first arm when the locking member is in the locked position and disengaging said projection just before the oblique face or curved ramp of the cam engages the corresponding part of the projection on the second arm when the electromagnet is actuated.

5. A locking device according to claim 3 wherein a counterweight is disposed on the side of the plate opposite to the cam for compensating the weight and flywheel effect thereof.

6. In an electronic safety ski binding having a movable sole retainer, wherein an electrical signal is generated to effect movement of the sole retainer, a locking device comprising:

a locked member connected to the sole retainer, said locked member being movable between a releasing position for enabling movement of the sole retainer and a retaining position for preventing movement of the sole retainer;

a locking member movable between a first position for holding said locked member in the retaining position and a second position for enabling movement of said locked member to the releasing position; and a rotatable member having abutment means for abutting said locking member to move said locking member from said first position to said second position in response to the generation of said electrical signal.

* * * * *